US010367313B2

(12) United States Patent
Wu et al.

(10) Patent No.: US 10,367,313 B2
(45) Date of Patent: Jul. 30, 2019

(54) ELECTRICAL CONNECTOR HAVING A MIDDLE METAL PLATE WITH TWO PAIRS OF FINGERS CONTACTING AN UPPER AND LOWER GROUND CONTACTS

(71) Applicant: FOXCONN INTERCONNECT TECHNOLOGY LIMITED, Grand Cayman (KY)

(72) Inventors: Jerry Wu, New Taipei (TW); Jun Chen, Kunshan (CN); Min-Qiang Zhang, Kunshan (CN); Yang-Tsun Hsu, New Taipei (TW); Qing-Bin Xia, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/892,389

(22) Filed: Feb. 8, 2018

(65) Prior Publication Data

US 2018/0233859 A1 Aug. 16, 2018

(30) Foreign Application Priority Data

Feb. 15, 2017 (CN) ..... 2017 1 0081641

(51) Int. Cl.

| | |
|---|---|
| ***H01R 24/60*** | (2011.01) |
| ***H01R 107/00*** | (2006.01) |
| ***H01R 13/504*** | (2006.01) |
| ***H01R 13/506*** | (2006.01) |
| ***H01R 13/6585*** | (2011.01) |
| ***H01R 13/6597*** | (2011.01) |

(52) U.S. Cl.

CPC ..... *H01R 13/6597* (2013.01); *H01R 13/5045* (2013.01); *H01R 13/6585* (2013.01); *H01R 13/506* (2013.01); *H01R 24/60* (2013.01); *H01R 2107/00* (2013.01)

(58) Field of Classification Search

CPC ..... H01R 13/6585; H01R 13/65807; H01R 13/6597; H01R 13/5045; H01R 13/506; H01R 23/688; H01R 23/7073; H01R 24/60; H01R 2107/00

USPC ..... 439/607.05

See application file for complete search history.

(56) References Cited

U.S. PATENT DOCUMENTS 8,262,411 B2 * 9/2012 Kondo ..... H01R 13/6658 439/607.01

8,684,769 B2 4/2014 Kao et al.

(Continued)

FOREIGN PATENT DOCUMENTS

CN 201639092 U 11/2010

*Primary Examiner* — Gary F Paumen

(74) *Attorney, Agent, or Firm* — Wei Te Chung; Ming Chieh Chang

(57) ABSTRACT

An electrical connector includes: an insulative housing having a tongue; an upper and lower rows of contacts secured to the insulative housing and exposed to two opposite faces of the tongue, the upper row of contacts including an upper ground contact and the lower row of contacts including a lower ground contact; and a metal plate disposed between the upper row of contacts and the lower row of contacts, wherein the metal plate has a pair of upper fingers contacting the upper ground contact and a pair of lower fingers contacting the lower ground contact.

7 Claims, 7 Drawing Sheets

(56) References Cited

U.S. PATENT DOCUMENTS

| | | | | |
|---|---|---|---|---|
| 8,784,134 | B2 * | 7/2014 | Wu | H01R 13/6598 439/607.05 |
| 8,864,506 | B2 * | 10/2014 | Little | H01R 13/658 439/108 |
| 9,178,319 | B2 | 11/2015 | Little et al. | |
| 9,484,679 | B2 * | 11/2016 | Guo | H01R 13/6585 |
| 9,735,511 | B2 * | 8/2017 | Kao | H01R 13/5202 |
| 10,027,065 | B1 * | 7/2018 | Lee | H01R 13/506 |
| 2016/0149348 | A1 * | 5/2016 | Kao | H01R 13/6585 439/607.05 |
| 2016/0156136 | A1 * | 6/2016 | Kao | H01R 13/6585 439/607.05 |
| 2017/0288326 | A1 * | 10/2017 | Wang | H01R 12/775 |
| 2017/0288352 | A1 * | 10/2017 | Tsai | H01R 13/516 |
| 2017/0338576 | A1 * | 11/2017 | Sato | H01R 4/184 |
| 2017/0346206 | A1 * | 11/2017 | Ju | H01R 24/78 |
| 2017/0346216 | A1 * | 11/2017 | Tada | H01R 12/707 |

* cited by examiner

ELECTRICAL CONNECTOR HAVING A MIDDLE METAL PLATE WITH TWO PAIRS OF FINGERS CONTACTING AN UPPER AND LOWER GROUND CONTACTS

BACKGROUND OF THE INVENTION

1. Field of the Invention

The present invention relates to an electrical connector having a metal plate disposed between an upper row of contacts and a lower row of contacts, wherein the metal plate has one or more contacting fingers for contacting one or more corresponding ground contacts.

2. Description of Related Art

U.S. Pat. No. 9,178,319 discloses a receptacle connector having a metallic shielding plate with a pair of spring tangs for contacting two corresponding upper grounding contacts.

SUMMARY OF THE INVENTION

An electrical connector comprises: an insulative housing having a tongue; an upper and lower rows of contacts secured to the insulative housing and exposed to two opposite faces of the tongue, the upper row of contacts including an upper ground contact and the lower row of contacts including a lower ground contact; and a metal plate disposed between the upper row of contacts and the lower row of contacts, wherein the metal plate has a pair of upper fingers contacting the upper ground contact and a pair of lower fingers contacting the lower ground contact.

DETAILED DESCRIPTION OF THE PREFERRED EMBODIMENT

Figure 1:
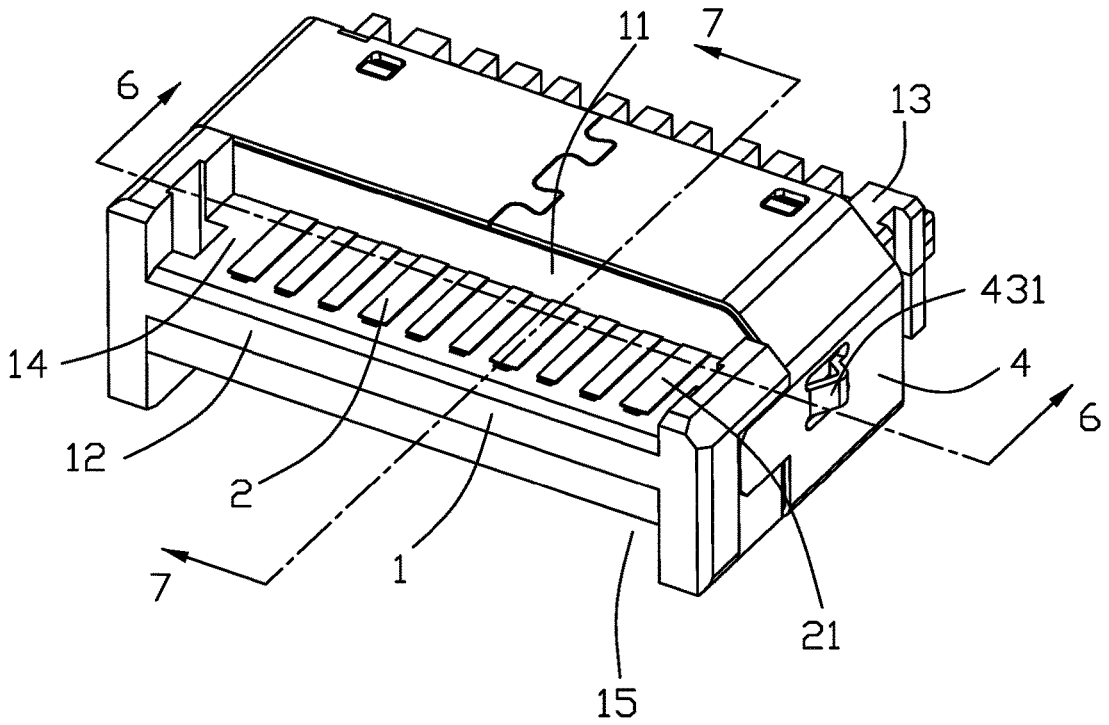
FIG. 1 is a front and top perspective view of an electrical connector in accordance with the present invention.
Figure 2:
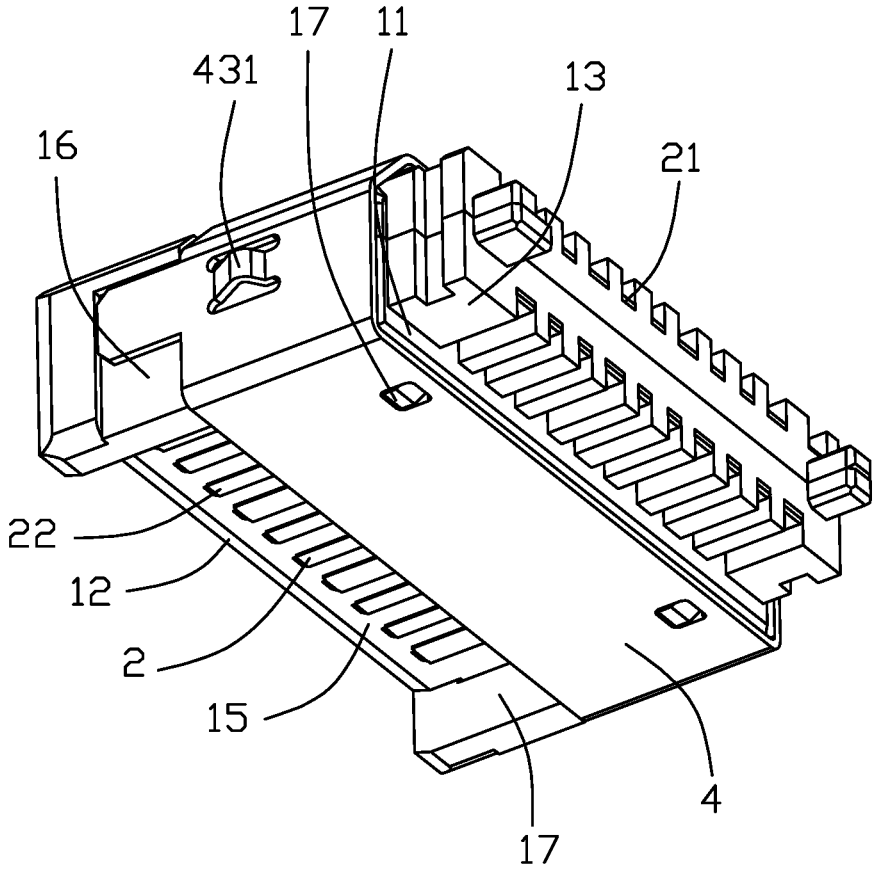
FIG. 2 is a rear and bottom perspective view of the electrical connector.

Referring to FIGS. 1 and 2, an electrical connector 100 in conformity to USB 3.1 standard plug comprises an insulative housing 1, two rows of contacts 2 secured to the insulative housing, and a metal plate 3 disposed in the housing between the upper row of contacts 21 and the lower row of contacts 22. The electrical connector 100 may further comprise a shielding shell 4 enclosing the insulative housing 1.

The insulative housing 1 includes a base 11, a front tongue 12, and a rear support 13. A first mating chamber 14 and a second mating chamber 15 are respectively formed above and below the tongue 12.

Referring to FIGS. 1-3 and 5, each row of contacts include four ground contacts 212 and three interposed differential signal pairs 211. Each contact 2 has an intermediate portion

2111, a front contacting portion 2112 exposed to a corresponding face of the tongue 12, and a rear soldering portion 2113 exposed to a corresponding face of the support 13.

Referring to FIGS. 3-7, the metal plate 3 spans approximately a plan area of the contacts 2. The metal plate 3 has a pair of upper fingers 31 contacting one of the four upper ground contacts 212, namely, one of the two middle ones in this embodiment. Specifically, the pair of upper fingers 31 contact the contacting portion 2112 and the soldering portion 2113 of the upper ground contact. The metal plate 3 also has a pair of lower fingers 32 contacting one of the four lower ground contacts 212, namely, one of the two middle ones in this embodiment. Specifically, the pair of lower fingers 32 contact the contacting portion 2112 and the soldering portion 2113 of the lower ground contact. The fingers 31 and 32 are conveniently stamped from edges or ends of the metal plate.

Referring to FIGS. 3-4 and 6-7, the insulative housing 1 may be of one-piece or may include interlocked upper housing part 101 and lower housing part 102 to together form the base 11, tongue 12, and support 13.

The upper housing part 101 has a base portion 111, a tongue portion 121, and a support portion 131. The base portion 111 has first and second mating walls 16 and 17 with the tongue portion 121 connected therebetween and a pair of latches 1111. The lower housing part 102 has a base portion 112, a tongue portion 122, and a support portion 132. The base portion 112 has a pair of holes 1121 receiving the pair of latches 1111.

The upper and lower housing parts 101 and 102 have respective grooves 141 and 142 receiving the upper and lower contacts 21 and 22. In this embodiment, the upper contacts 21 and the lower contacts 22 are respectively embedded within the corresponding upper housing part 101 and lower housing part 102 via an insert-molding process.

A bottom face of the upper housing part 101 has plural apertures 151 at the base portion 111, the tongue portion 121, and the support portion 131 corresponding to the contacts 21; a top face of the lower housing part 102 has plural apertures 152 at the base portion 112, the tongue portion 122, and the support portion 132 corresponding to the contacts 22. The pair of upper fingers 31 of the metal plate 3 extend through the apertures 151 to contact the contacting portion 2112 and the soldering portion 2113 of the upper ground contact 212; the pair of lower fingers 32 of the metal plate 3 extend through the apertures 152 to contact the contacting portion 2112 and the soldering portion 2113 of the lower ground contact 212. The base portions 111 and 112 of the upper and lower housing parts 101 and 102 further have respective apertures 153 in fluid communication with the grooves 141 and 142, respectively.

Figure 3:
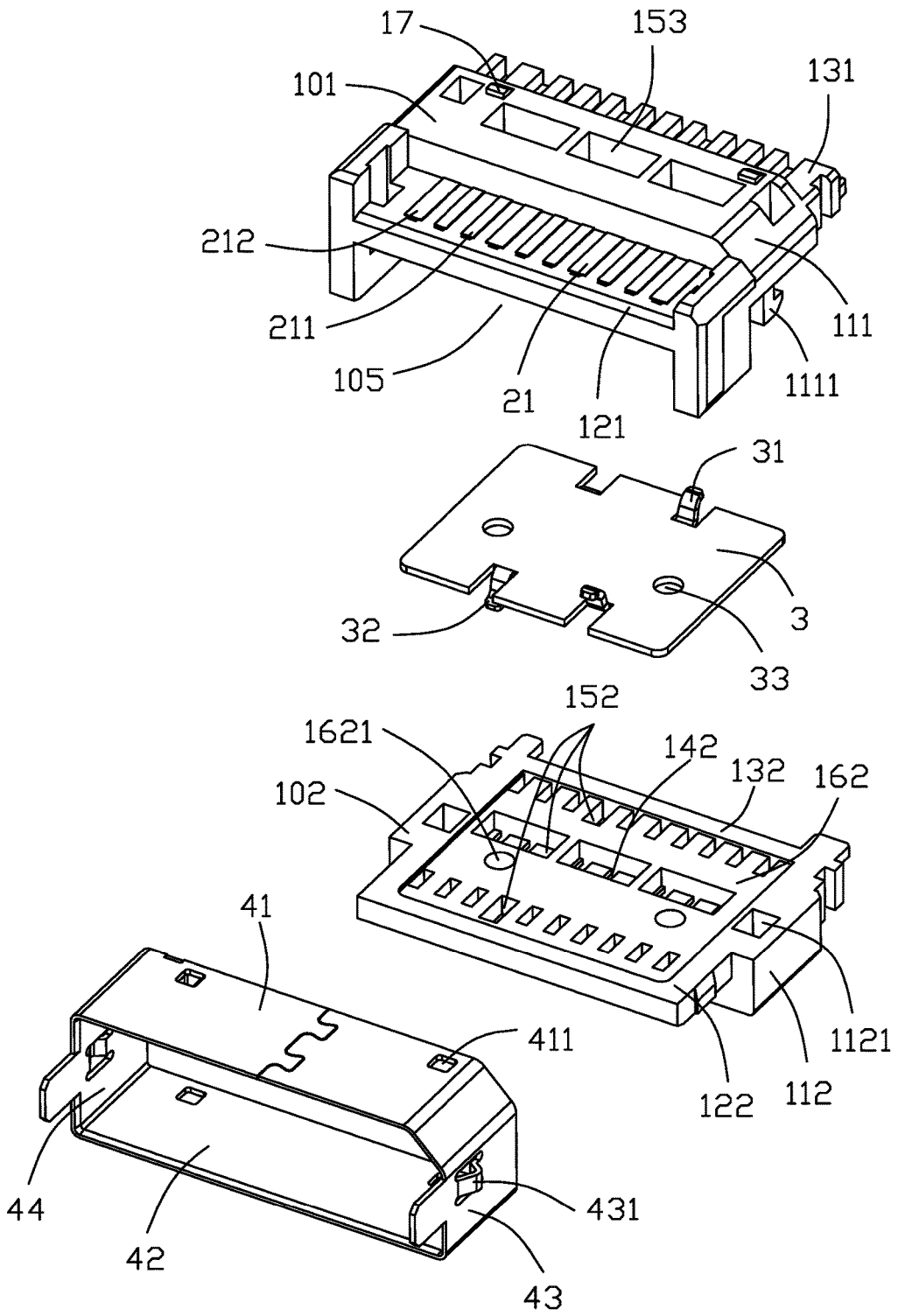
FIG. 3 is an exploded view of the electrical connector in FIG. 1.
Figure 4:
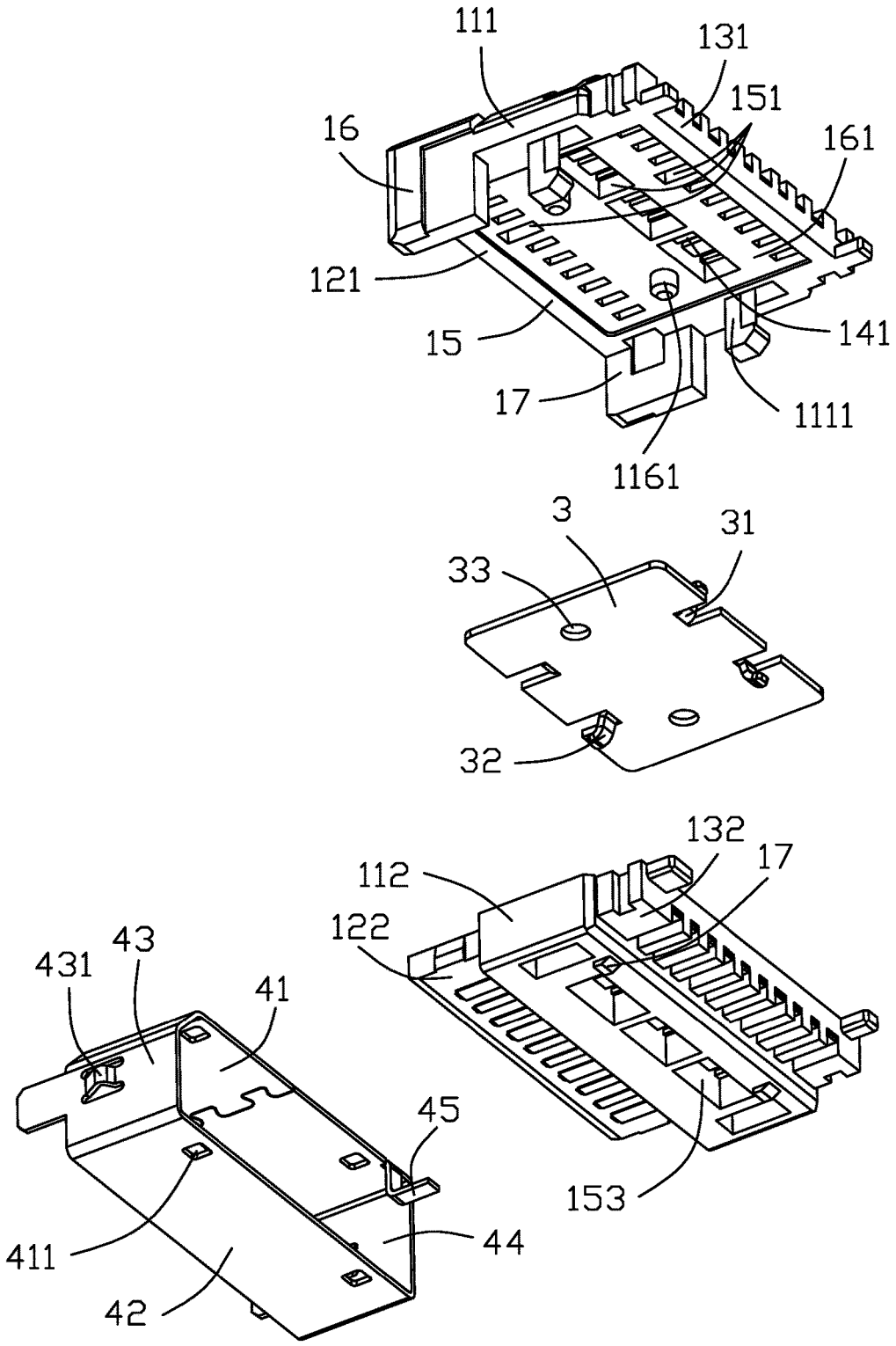
FIG. 4 is an exploded view of the electrical connector in FIG. 2.
Figure 5:
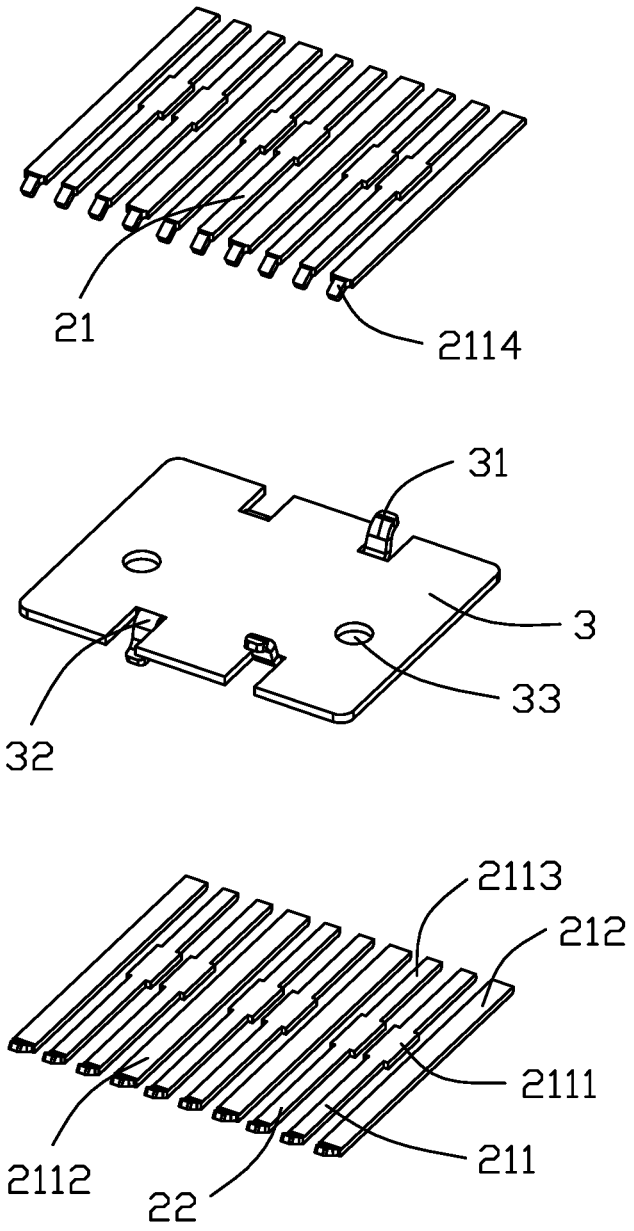
FIG. 5 is an exploded view schematically showing an upper and lower rows of contacts and a middle metal plate of the electrical connector.

Referring to FIGS. 3 and 4, the metal plate 3 is positioned between the upper housing part 101 and the lower housing part 102. The upper housing part 101 has a bottom recess 161 and the lower housing part 102 has a top recess 162, the recesses of the upper and lower housing parts together defining a chamber to accommodate the metal plate. The upper housing part 101 further has a pair of posts 1611 in the bottom recess 161, the lower housing part 102 further has a pair of holes 1621 in the top recess 162, and the metal plate 3 further has a pair of through holes 33.

In this embodiment, the intermediate portion 2111 is widened or has a widened section in order to improve impedance matching. Each contact 21 or 22 may further have an embedded portion 2114.

Referring to FIGS. 1-4, the shielding shell 4 is mounted to the base 11 of the insulative housing 1. The shielding shell 4 includes a top wall 41, a bottom wall 42, and two side walls 43 and 44. Each of the top wall 41 and the bottom wall 42 has a pair of holes 411 and each of the upper housing part 101 and the lower housing part 102 has a pair of corresponding protrusions 18. Each of the two side walls 43 and 44 has a respective latch 431. The top wall 41 further has an L-shaped grounding leg 45 aligned with and coplanar to the soldering portions 2113 of the upper contacts 21.

Figure 6:
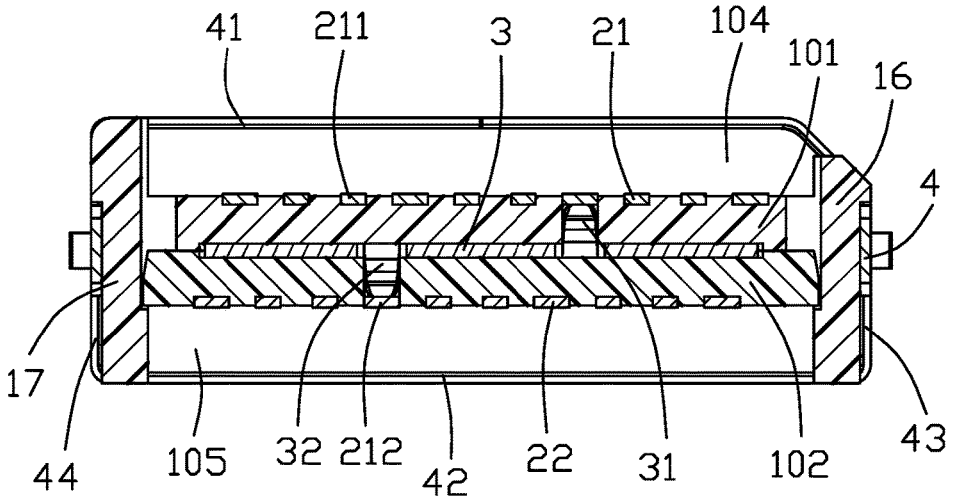
FIG. 6 is a cross-sectional view of the electrical connector taken along line A-A in FIG. 1.
Figure 7:
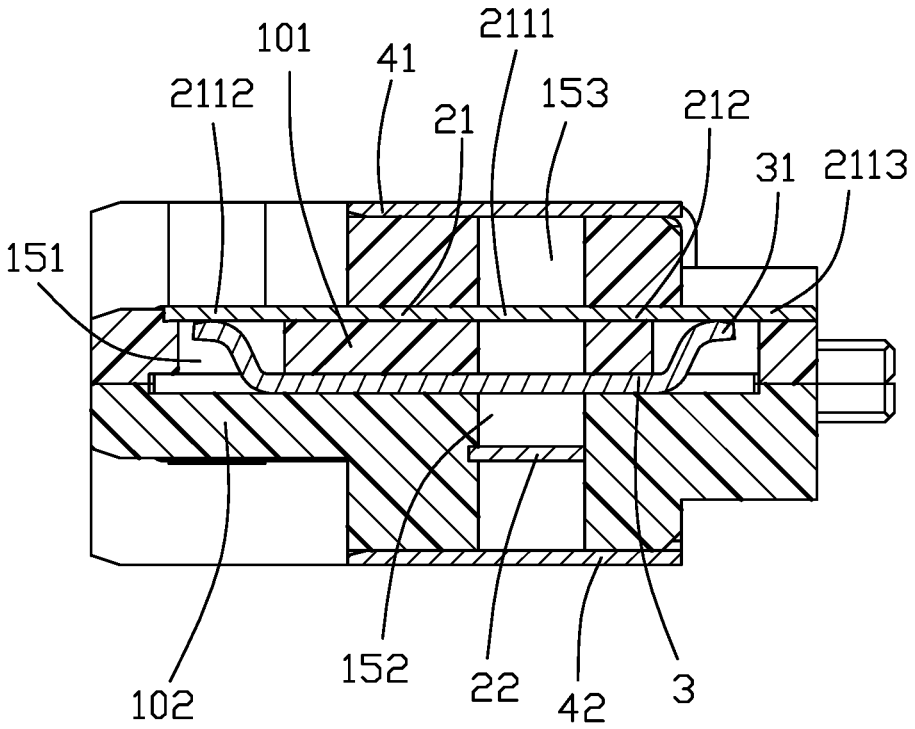
FIG. 7 is a cross-sectional view of the electrical connector taken along line B-B in FIG. 1.

Preferably, the upper housing part 101 and the upper contacts 21 are insert molded together and the lower housing part 102 and the lower contacts 22 are insert molded together. The two subassemblies are then latched to each other with the metal plate 3 being sandwiched therebetween. As shown in FIG. 6, the upper row of contacts 21 are offset from the lower row of contacts 22. Notably, in this embodiment, the upper housing part 101 and the lower housing part 102 form the recesses 161, 162 therein to snugly receive the corresponding metal plate 3 both vertically and circumferentially so as not to expose the metal plate 3 transversely. Also, as shown in FIG. 7, a corresponding portion of the upper contact 21 as well as that of the lower contact 22 is fully circumferentially exposed in the corresponding aperture 153 which extends through the upper housing part 101 and the lower housing part 102 in the vertical direction, while the metal plate 3 and the shell 4 block the aperture 153 in the vertical direction. Understandably, the aperture 153 may adjust the impedance of the contacts for achieving the superior electrical performance.

What is claimed is:

1. An electrical connector comprising:

an insulative upper housing part with a plurality of upper contacts embedded therein via an insert-molding process;

a lower insulative housing part with a plurality of lower contacts embedded therein via another insert-molding process;

a metal plate sandwiched between the upper housing part and the lower housing part in a vertical direction with a plurality of grounding fingers respectively contacting corresponding ground contacts of the plurality of upper contacts and the plurality of lower contacts in the vertical direction; and a metallic shell circumferentially enclosing the upper housing part and the lower housing part; wherein the upper housing part forms an upper aperture extending therethrough in the vertical direction to circumferentially expose a portion of each corresponding upper contact while being blocked by the shell and the metal plate at two ends thereof in the vertical direction; and the lower housing part forms a lower aperture extending therethrough in the vertical direction to circumferentially expose a portion of each corresponding lower contact while being blocked by the shell and the metal plate at two ends thereof in the vertical direction.

2. The electrical connector as claimed in claim 1, wherein the upper aperture and the lower aperture are aligned with each other in the vertical direction.

3. The electrical connector as claimed in claim 1, wherein the upper housing part and the lower housing part form respectively recesses to snugly receive the metal plate in at least the vertical direction.

4. The electrical connector as claimed in claim 3, wherein said recesses further snugly receive the metal plate horizontally circumferentially.

5. An electrical connector comprising:

a plurality of upper contacts integrally formed within an insulative upper housing part via an insert-molding process and including an upper ground contact, each of said upper contacts including a front contacting portion and a rear soldering portion along a front-to-back direction;

a plurality of lower contacts integrally formed within an insulative lower housing part via another insert-molding process and including a lower ground contact, each of said lower contacts including a front contacting portion and a rear soldering portion along the front-to-back direction; and a metal plate disposed between the insulative upper housing part and the insulative lower housing part in a vertical direction perpendicular to said front-to-back direction; wherein the metal plate has a pair of upper fingers spaced from each other along the front-to-back direction and respectively contacting the front contacting portion and the rear soldering portion of the upper ground contact, and a pair of lower fingers spaced from each other along the front-to-back direction and respectively contacting the front contacting portion and the rear soldering portion of the lower ground contact.

6. An electrical connector comprising:

a plurality of upper contacts integrally formed within an insulative upper housing part via an insert-molding process and including an upper ground contact, each of said upper contacts including a front contacting portion and a rear soldering portion along a front-to-back direction;

a plurality of lower contacts integrally formed within an insulative lower housing part via another insert-molding process and including a lower ground contact, each of said lower contacts including a front contacting portion and a rear soldering portion along the front-to-back direction; and a metal plate disposed between the insulative upper housing part and the insulative lower housing part in a vertical direction perpendicular to said front-to-back direction; wherein the metal plate has a pair of upper fingers spaced from each other along the front-to-back direction and respectively contacting two different positions of the upper ground contact along the front-to-back direction, and a pair of lower fingers spaced from each other along the front-to-back direction and respectively contacting two different positions of the lower ground contact along the front-to-back direction; wherein the insulative upper housing part includes a pair of apertures dimensioned to properly comply with the upper spring fingers in the front-to-back direction to protectively allow the pair of upper fingers to extend therethrough, respectively, and the insulative lower housing part forms a pair of apertures dimensioned to properly comply with the lower spring fingers in the front-to-back direction to protectively allow the pair of lower fingers to extend therethrough, respectively.

7. The electrical connector as claimed in claim 6, wherein the pair of upper fingers are located at opposite front and rear edges of the metal plate, and the pair of lower fingers are located at said opposite front and rear edges of the metal plate.

* * * * *